US008216117B2

(12) United States Patent
Brotzki et al.

(10) Patent No.: US 8,216,117 B2
(45) Date of Patent: Jul. 10, 2012

(54) COOLING OF ROLLS IN CONTINUOUS CASTING PLANTS

(75) Inventors: Herbert Brotzki, Duisburg (DE); Thomas Fest, Duisburg (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 12/460,295

(22) Filed: Jul. 16, 2009

(65) Prior Publication Data

US 2009/0314468 A1 Dec. 24, 2009

Related U.S. Application Data

(60) Division of application No. 10/543,075, filed on Jul. 21, 2005, now Pat. No. 7,601,110, which is a continuation of application No. PCT/EP2004/000278, filed on Jan. 16, 2004.

(30) Foreign Application Priority Data

Jan. 23, 2003 (DE) ..... 103 02 474

(51) Int. Cl.
*F28F 5/02* (2006.01)
*F16C 37/00* (2006.01)
*F16C 13/00* (2006.01)

(52) U.S. Cl. ..... 492/46; 492/47; 492/1; 384/316; 384/321; 384/418; 384/476

(58) Field of Classification Search ..... 492/47, 492/1, 46; 384/313, 315, 316, 317, 321, 384/418, 476, 900; 248/901, 659
See application file for complete search history.

(56) References Cited

U.S. PATENT DOCUMENTS

| | | | | | |
|---|---|---|---|---|---|
| 1,820,985 | A | * | 9/1931 | McKee | 198/788 |
| 2,731,306 | A | * | 1/1956 | Keller | 384/321 |
| 3,704,669 | A | * | 12/1972 | Christoff | 101/350.3 |
| 3,753,463 | A | * | 8/1973 | Segelken et al. | 165/47 |
| 3,894,323 | A | * | 7/1975 | Hamlen | 165/89 |
| 4,027,928 | A | * | 6/1977 | Williams | 384/317 |
| 4,459,726 | A | * | 7/1984 | O'Brien et al. | 492/7 |
| 4,883,369 | A | * | 11/1989 | Jude et al. | 384/476 |
| 4,948,269 | A | * | 8/1990 | Hamilton | 384/467 |
| 5,010,633 | A | * | 4/1991 | Brown et al. | 492/5 |
| 5,058,496 | A | * | 10/1991 | Wittkopf | 100/35 |
| 5,592,882 | A | * | 1/1997 | Toyoda | 101/487 |
| 5,823,108 | A | * | 10/1998 | Kelm | 101/348 |
| 5,915,843 | A | * | 6/1999 | Mattera | 384/316 |

(Continued)

FOREIGN PATENT DOCUMENTS

DE 2637179 A * 3/1977

(Continued)

*Primary Examiner* — Essama Omgba
(74) *Attorney, Agent, or Firm* — Lucas & Mercanti, LLP; Klaus P. Stoffel

(57) ABSTRACT

A method for cooling a roller device, which has a right bearing housing, a left bearing housing, and a roller, which is rotatably supported by journals in the bearing housings, especially of strand guide rolls, roller table rollers, pinch rolls, support rolls, or driving rolls in continuous casting plants, in which a cooling medium cools the bearings mounted in the bearing housings and passes through an axial bore in the roller. The cooling medium enters the bearing housing of the roller device on one side, passes around the bearing mounted in this bearing housing, then flows through the axial bore in the roller to the other side, passes around the bearing mounted in the other bearing housing, and is then discharged from the roller device.

2 Claims, 3 Drawing Sheets

U.S. PATENT DOCUMENTS 5,967,958 A * 10/1999 Borkenhagen et al. ..... 492/46
6,059,003 A * 5/2000 Wittkopf ..... 156/555
6,202,556 B1 * 3/2001 Lagger ..... 101/216
6,405,779 B1 * 6/2002 Wittkopf ..... 156/555
6,554,755 B2 * 4/2003 Kubik ..... 492/46
7,389,728 B2 * 6/2008 Hieronymus et al. ..... 101/479
7,568,428 B2 * 8/2009 Reichel ..... 101/487
7,601,110 B2 * 10/2009 Brotzki et al. ..... 492/46
2009/0242276 A1 * 10/2009 Hummes et al. ..... 175/57

FOREIGN PATENT DOCUMENTS

JP 08168859 A * 7/1996

* cited by examiner

COOLING OF ROLLS IN CONTINUOUS CASTING PLANTS

CROSS-REFERENCE TO RELATED APPLICATIONS

This application is a Divisional Application of U.S. patent application Ser. No. 10/543,075, filed Jul. 21, 2005, now U.S. Pat. No. 7,601,110, issued Oct. 13, 2009, which, in turn, is a Continuation Application of U.S. National Phase PCT/EP2004/000278, filed Jan. 16, 2004

BACKGROUND OF THE INVENTION

The invention concerns a method for cooling a roller device, which consists of a right bearing housing, a left bearing housing, and a roller, which is rotatably supported by journals in the bearing housings, especially of strand guide rolls, roller table rollers, pinch rolls, support rolls, or driving rolls in continuous casting plants, in which a cooling medium is passed through an axial bore in the roller. The invention also concerns a roller device.

DE 42 07 042 C1 describes a device for the coupling of the cooling medium conveyance of a support or pinch roll, especially for continuous casting plants, which is supported by means of journals in bearing blocks by roller bearings and through which a cooling medium flows through axial bores in the journals. To create a device of this general type with a long service life, which guarantees reliable supply and discharge of the cooling medium with a structurally simple design in a way that allows easy maintenance, it is proposed that each bearing block is sealed by a cover, that the cover has a flow channel, which is connected at one end to a coolant supply and discharge and opens in the area of the journal bore at the other end, that an elastic socket is provided between the channel mouth of the cover and the bore of the roll, that the head of the socket has a seal, and that the seal is in contact with a sealing surface that is arranged coaxially with the axis of the roll.

EP 0 859 767 B1 describes a rotary passage for the cooling water feed and discharge of a guide roll in a continuous casting plant. The objective of this invention is to create a rotary passage of the aforementioned type, whose seal acting between the cover plate and the journal has a less complicated design than the seal in the previously known rotary passage. In accordance with the invention, this objective is achieved by forming the middle part of the seal as an annular, flange-shaped plastic or rubber diaphragm, whose inner edge is vulcanized on the bushing and whose outer edge is vulcanized on the flange. This rotary passage is characterized by its simple design and compact shape. It can be mounted completely on the end face of the journal. Therefore, it is no longer necessary to enlarge the axial channel of the distribution system in the cooling roll in the front end region of the journal to house parts of the seal therein. The central channel can thus have the same cross section along its whole length.

Modifications of a rotary passage are described, e.g., in EP 1 125 656 A1 and WO 99/26745.

DE 198 16 577 C1 describes a strand guide device for producing metal strands, especially steel strands, with upper and lower frames divided into segments, which are equipped with rolls, which are connected to a cooling medium supply device by connecting lines. To create a low-maintenance, leakproof connection between the rolls and the cooling medium supply device, which can be easily disconnected and reconnected on site and can be clearly assigned, it is proposed, in accordance with the invention, that the rolls are provided with sockets, whose mouths are horizontally oriented, that the sockets correspond to connecting lines, which are formed as metal tubes, which are connected at one end to the cooling medium supply device and are connected at the other end with a seal that allows leak-free axial and lateral motion between the end of the tube and the socket.

A disadvantage of the previously known designs of a roller device of this type is that the cooling medium is fed and discharged on only one side of the roll. In this regard, the cooling medium is conveyed through an axial bore in the roll to the opposite side, where it is deflected back in the opposite direction, and conveyed through an annular channel to the outlet side, from which there is a connection to a cooling and storage container.

SUMMARY OF THE INVENTION

Proceeding on the basis of this prior art, the objective of the invention is to increase the cooling effect of a roller device of this type and to improve the assembly and disassembly of the individual components.

In accordance with the invention, in a method for cooling a roller device, which consists of a right bearing housing, a left bearing housing, and a roller, which is rotatably supported by journals in the bearing housings, especially of strand guide rolls, roller table rollers, pinch rolls, support rolls, or driving rolls in continuous casting plants, in which a cooling medium is passed through an axial bore in the roller, this objective is achieved by virtue of the fact that the cooling medium additionally cools the bearings mounted in the bearing housings.

In an advantageous modification of the invention, the cooling medium enters the bearing housing of the roller device on one side, passes around the bearing mounted in this bearing housing, then flows through the axial bore in the roller to the other side, passes around the bearing mounted in the other bearing housing, and is then discharged from the roller device.

In a special modification of the invention, the cooling medium passes from the bearing housing into the rotary passage through a rigid or flexible connector that is flange-mounted on the end face.

In the roller device of the invention, bores are arranged around the bearings mounted in the bearing housings and form a closed cooling channel.

In an advantageous design of the invention, a discharge bore for the cooling medium is arranged on the end face of the bearing housing and is located outside the bearing cover.

It is also advantageous that the rotary passage, which is arranged centrally in the bearing cover, is connected with a discharge bore on the end face of the bearing housing by a rigid or flexible connector.

The invention further provides that the rotary passage is detachably mounted in the bearing cover.

In an advantageous design of the invention, the rotary passage in the bearing covers can compensate linear expansion of the roller.

A specific embodiment of the invention is explained in greater detail with reference to schematic drawings.

DETAILED DESCRIPTION OF THE INVENTION

Figure 1:
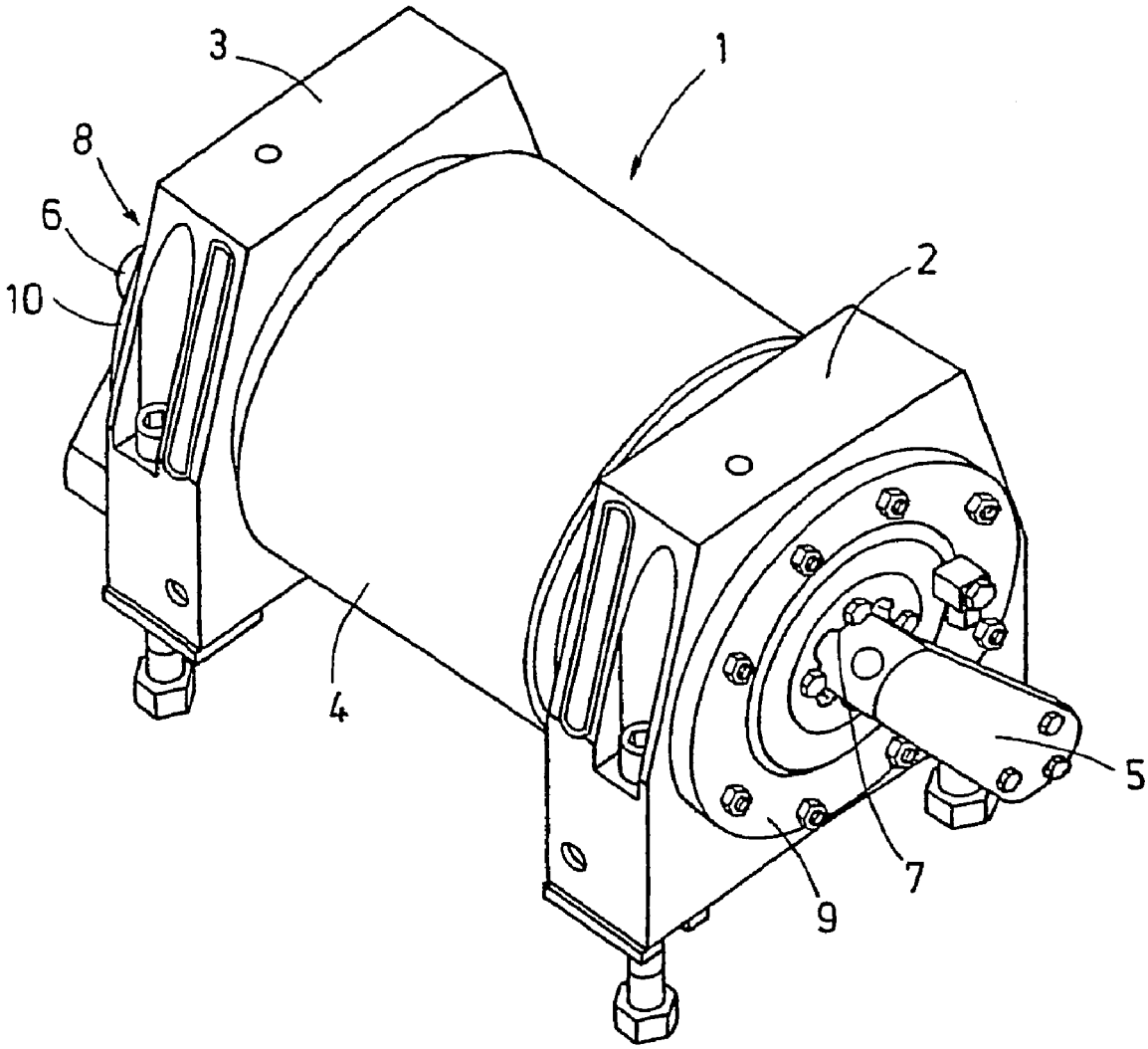
FIG. 1 shows a roller device in a perspective view.

FIG. 1 shows a roller device 1, which consists of a right bearing housing 2, a left bearing housing 3, and a roller 4.

Connectors 5, 6, which connect the discharge bores with the rotary passages 7, 8 in the bearing covers 9, 10, are flange-mounted on the end faces. The connector 5, 6 is detached for maintenance or in the event of a problem. The bearing cover 9, 10 with the rotary passage 7, 8 can then be removed from the bearing housing 3, 4. There is also the possibility of removing only the rotary passage 7, 8.

Figure 2:
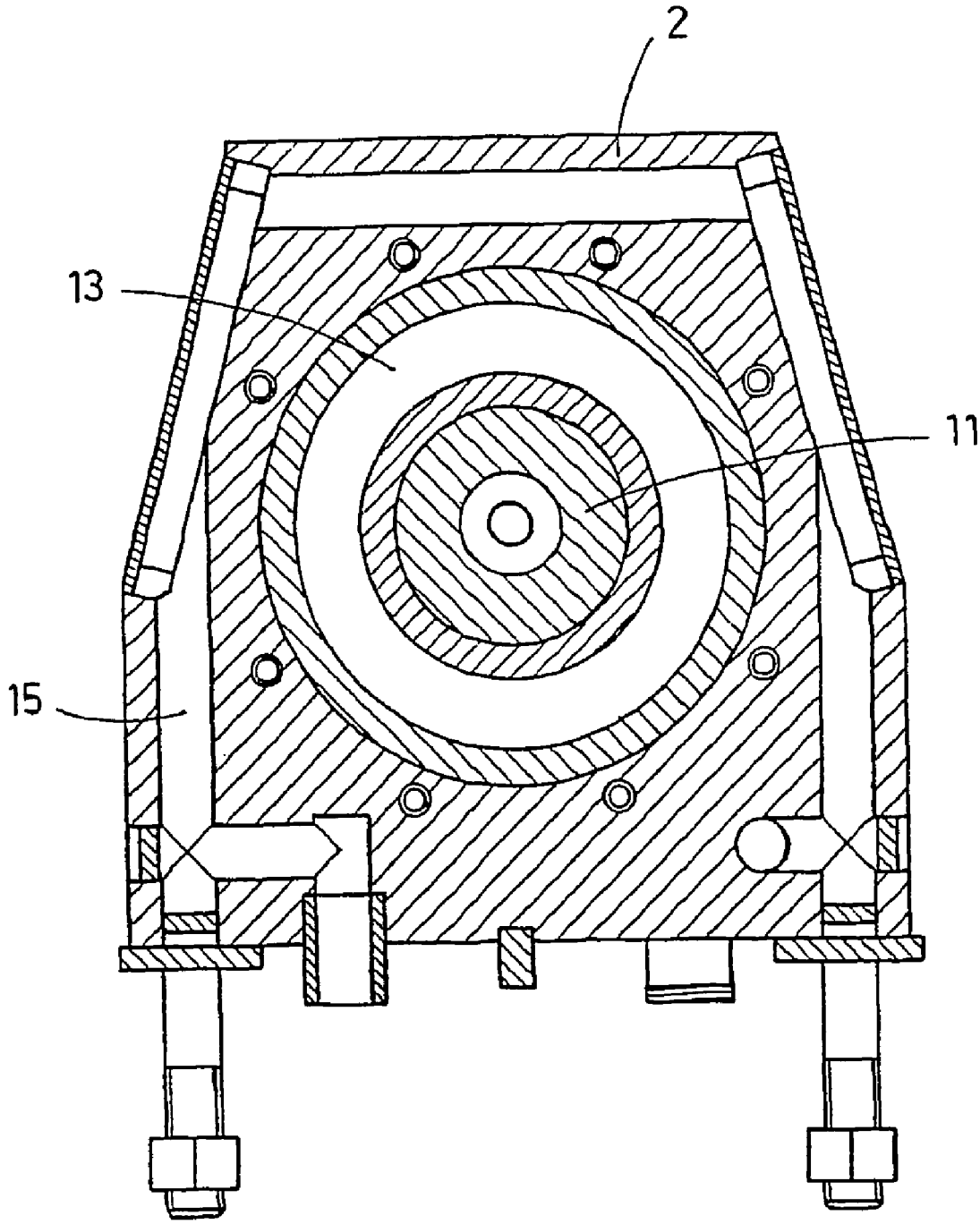
FIG. 2 shows a bearing housing in longitudinal section.
Figure 3:
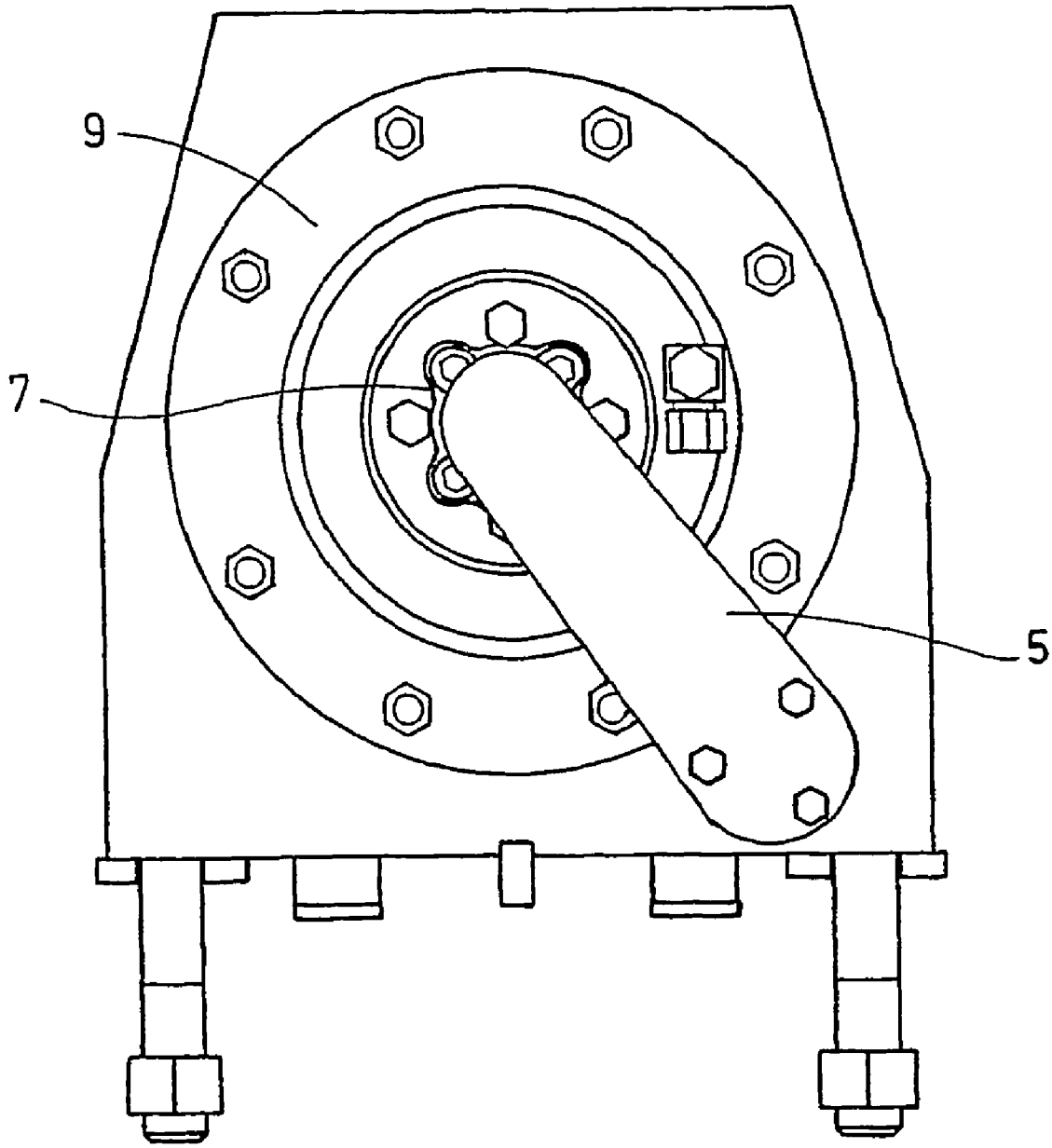
FIG. 3 shows the bearing housing of FIG. 2 in a side view (end face).

The arrangement of the bores 15 for the closed cavity around a bearing 13 is illustrated in FIG. 2. The cavity is formed by several bores 15, which are located at a distance from the outer surfaces of the bearing housing 2. In this regard, the bores merge with each other at an angle or are positioned at right angles to each other. To obtain a closed cavity, individual bores are sealed at the surface of the bearing housing 2. The cooling medium is introduced into the bearing housing 2 on the underside, flows through the cavity, which is arranged around the bearing 13, and arrives at a discharge bore on the end face of the bearing housing 2. FIG. 3 shows the end face of a bearing housing 2. The discharge bore, which is arranged on the right side, next to the bearing cover 9, is connected by a connector 5 with the rotary passage 7. The rotary passage 7 is centrally located in the bearing cover 9.

LIST OF REFERENCE NUMBERS

1 roller device
2 bearing housing, right side
3 bearing housing, left side
4 roller
5 connector, right side
6 connector, left side
7 rotary passage, right side
8 rotary passage, left side
9 bearing cover, right side
10 bearing cover, left side
11 roller journal, right side
12 roller journal, left side
13 bearing, right side
14 bearing, left side
15 bores

The invention claimed is:

1. A method for cooling a roller device, which consists of a right bearing housing, a left bearing housing, and a roller, which is rotatably supported by journals in the bearing housings in continuous casting plants, in which a cooling medium cools bearings mounted in each of the bearing housings and passes through a central axial bore in the roller, the method comprising: introducing the cooling medium through a cooling medium inlet in a first of the bearing housings on one side of the roller device so that all of the cooling medium passes around the bearing mounted in the first bearing housing through bores arranged around the bearing in the first bearing housing; passing all of the cooling medium through the central axial bore in the roller; passing all of the cooling medium around the bearing mounted in a second of the bearing housings through bores arranged around the bearing in the second bearing housing, wherein the bores in the housings form a closed cooling channel; and then discharging all of the cooling medium from another side of the roller device through a discharge bore in an end face of the second bearing housing.

2. The method in accordance with claim 1, wherein the cooling medium passes from the bearing housing into a rotary passage through a rigid or flexible connector that is flange-mounted on the end face.

* * * * *